United States Patent [19]

Fujikawa et al.

[11] Patent Number: 4,490,309

[45] Date of Patent: Dec. 25, 1984

[54] INTEGRATED FUEL CONTROL SYSTEM FOR GASOLINE ENGINE

[75] Inventors: Tetsuzo Fujikawa, Kobe; Makizo Hirata; Shinichi Tamba, both of Kakogawa, all of Japan

[73] Assignee: Kawasaki Jukogyo Kabushiki Kaisha, Tokyo, Japan

[21] Appl. No.: 532,966

[22] Filed: Sep. 16, 1983

[30] Foreign Application Priority Data

Sep. 21, 1982 [JP] Japan ..... 57-165295

[51] Int. Cl.[3] ..... F02M 1/02

[52] U.S. Cl. ..... 261/52; 261/64 E; 123/179 G

[58] Field of Search ..... 261/52, 64 E; 123/179 G, 395

[56] References Cited

U.S. PATENT DOCUMENTS

| | | | |
|---|---|---|---|
| 2,908,263 | 10/1959 | Brown | 123/395 |
| 2,982,275 | 5/1961 | Doman et al. | 261/52 |
| 3,093,699 | 6/1963 | Demitz | 261/52 |
| 3,305,223 | 2/1967 | Reichenbach | 261/52 |
| 3,823,700 | 7/1974 | Gumtow | 261/64 E |

FOREIGN PATENT DOCUMENTS

| | | | |
|---|---|---|---|
| 540659 | 5/1957 | Canada | 261/52 |
| 2209125 | 9/1973 | Fed. Rep. of Germany | 123/179 G |
| 57-26629 | 2/1982 | Japan . | |

*Primary Examiner*—Tim Miles

*Attorney, Agent, or Firm*—Leydig, Voit, Osann, Mayer and Holt

[57] ABSTRACT

An integrated fuel control system for a gasoline engine including a linkage composed of a plurality of pivotable members which enables an operator to effect control of the choking condition of the gasoline engine and the magnitude of its power satisfactorily through a single operating element.

1 Claim, 6 Drawing Figures

INTEGRATED FUEL CONTROL SYSTEM FOR GASOLINE ENGINE

BACKGROUND OF THE INVENTION (1) Field of the Invention

This invention relates to a fuel control system for a gasoline engine which enables both choking and throttling to be effected by remote control through a common operating mechanism.

(2) Description of the Prior Art

In gasoline engines suitable for use with lawn mowers, for example, of the prior art, it has hitherto been customary to use separate mechanisms for effecting choking and throttling, and this has made choking and throttling operations troublesome to perform. Moreover, when an attempt is made to rely on remote control to eliminate the need to manually handle the mechanisms in the vicinity of the engine in the interest of increased safety of operation, two systems of remote control mechanism are required, so that the fuel control system becomes complex in construction and difficulties are faced with in putting in to practical use.

To obviate the aforesaid disadvantages of the fuel control system of the prior art, proposals have been made to use a fuel control system of an intergrated type which enables choking and throttling operations to be performed in conjunction with each other, as described in Japanese Utility Model Laid-Open No. 26629/82, for example. In the integrated fuel control system of the prior art referred to hereinabove, an idling position and a choking position are set at opposite ends of the range of movement of an operating mechanism and a full-open throttle position is set midway between the idling position and the choking position. Thus, when a normal operation of the engine is performed by bringing a throttle valve to a full-open position, the operating mechanism might inadvertently be held in a position which is displaced from the full-open throttle position toward the choking position. When this happened, engine operation would continue while a choke valve is partly closed, thereby increasing fuel consumption. Also, the integrated fuel control system of the prior art has suffered the disadvantage that since the throttle valve is in the full-open position when the operating mechanism is in the choking position, the throttle valve would be temporarily brought to a full-open position and the number of revolutions of the engine would suddenly rise immediately after engines startup is effected by using the choke valve or when the operating mechanism is returned to the idling position. Moreover, an attempt to use common specifications for both the fuel control system of the integrated type and that of the separation type of the prior art to reduce production cost would fall through because of the need to effect changes on a large scale in the governor spring and other parts in the case of an engine equipped with a governor.

SUMMARY OF THE INVENTION

This invention has been developed for the purpose of obviating the aforesaid disadvantages of the integrated fuel control system for a gasoline engine of the prior art. Accordingly, the invention has as its object the provision of an improved integrated fuel control system for a gasoline engine which has connections of improved construction between different mechanisms of the system.

The outstanding characteristic of the invention is that a full-open throttle position and a choking position are set at opposite ends of the range of movement of a control lever coupled to an operating mechanism and an idling position is set midway between the full-open throttle position and the choking position in the range of movement of the control lever.

The above and further objects and novel features of the invention will more fully appear from the following detailed description when the same is read in conjunction with the accompanying drawings. It is to be expressly understood, however, that the drawings are for purposes of illustration only and are not intended as a definition of the limits of the invention.

DESCRIPTION OF THE PREFERRED EMBODMENTS

Figure 1:
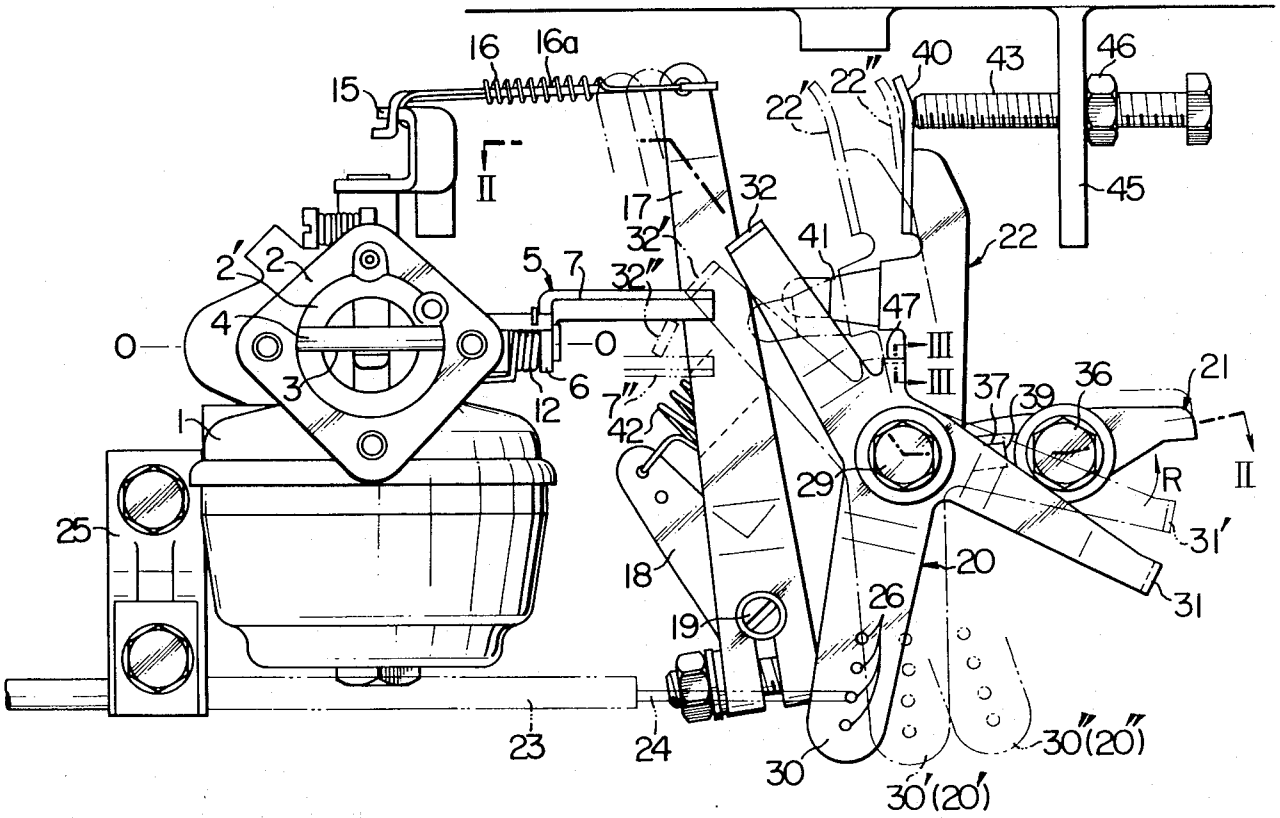
FIG. 1 is a front view of the integrated fuel control system for a gasoline engine comprising one embodiment of the invention.

Referring to FIG. 1, a carburetor 1 is connected to an air cleaner, not shown, mounted on a flange 2 through a suction conduit 2' in which a choke valve 3 is supported through a choke valve shaft 4. A choke lever 5 is secured to an end portion of the shaft 4 which extends rightwardly in FIG. 1 from the suction conduit 2' of the carburetor 1. The choke lever 5 which is formed of sheet metal includes a portion 6 secured to the shaft 4 and an arm portion 7 projecting from the portion 6 in a direction opposite the suction conduit 2' (or rightwardly in FIG. 1). The arm portion 7 which is parallel to a center line O—O of the shaft 4 is disposed obliquely upwardly of the center line O—O when it is in a choke valve opening position shown in solid lines. As the arm portion 7 is pressed to moved downwardly to a dash-and-two-dot line position 7'' as subsequently to be described, rotation of the shaft 4 can be achieved to close the choke valve 3. Mounted between the portion 6 and the suction conduit 2' is a torsion coil spring 12 biasing the shaft 4 toward a choke valve opening direction.

A lever portion 15 of a throttle valve is connected at its forward end to a forward end of a governor arm 17 through a tension coil spring 16 and a rod 16*a*. The arm 17 is secured at its base to a governor shaft 19 which also has a governor lever 18 secured thereto at its base. A governor body, not shown, is of a centrifugal type and has a built-in weight.

The integrated fuel control system comprising a choking mechanism and a throttling mechanism of the aforesaid construction has assembled therewith an operating mechanism comprising a control lever 20, a link plate 21, a throttle lever 22 and a Bowden wire 23.

The outer tube of the wire 23 is securely fixed to a crankcase, not shown, through a clamp 25 in the vicinity of the carburetor 1, and a forward end of the inner cable 24 is fitted and secured in one of a plurality of apertures 26 formed in the control lever 20.

Figure 2:
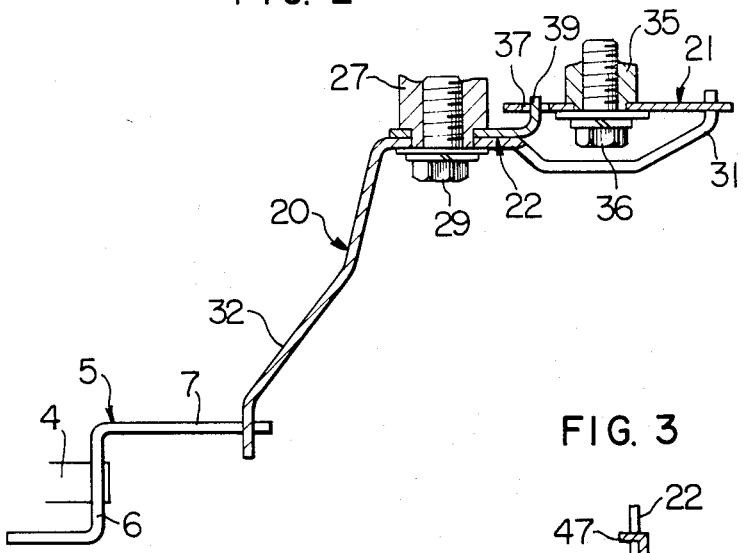
FIGS. 2 and 3 are sectional views taken along the lines II—II and III—III respectively in FIG. 1.

Referring to FIG. 2 which is a sectional view taken along the line II—II in FIG. 1, the control lever 20 is fitted at an opening formed at its central portion over a cylindrical boss 27 on the crankcase, not shown, and pivotably secured in place by a bolt 29 threadably connected to the cylindrical boss 27. The lever 20 includes, as shown in FIG. 1, a connecting arm portion 30, a link arm portion 31 and a choke arm portion 32 extending away from the vicinity of the bolt 29 in three directions. The connecting arm portion 30 extending downwardly is formed with four apertures 26 spaced apart from one another lengthwise of the arm portion 30 for connection with the inner cable 24 described hereinabove. By connecting the inner cable 24 to different ones of the apertures 26, it is possible to effect adjustments of the angle of pivotal movement of the lever 20 with respect to the magnitude of movement of the cable 24. The link arm portion 31 extending obliquely downwardly from the vicinity of the bolt 29 in a direction away from the carburetor 1 has a bent forward end portion which, as shown in FIG. 2, is located beneath the link plate 21. The choke arm portion 32 extends obliquely upwardly form the vicinity of the bolt 29 as shown in FIG. 1 and is bent in the vicinity of the bolt 29 as shown in FIG. 2. The choke arm portion 32 has a forward end portion which is located immediately above the arm portion 7 of the choke lever 5.

The link plate 21 formed with an opening at its central portion is fitted at the opening over a cylindrical boss 35 and pivotably secured in place by a bolt 36 threadably connected to the boss 35. The plate 21 includes a portion extending in a direction opposite the boss 27 (or rightwardly in FIG. 2) which is located above the forward end portion of the link arm portion 31, and a portion extending in a direction toward the boss 27 (or leftwardly in FIG. 2) which is formed with a slot 37 having a major dimension extending lengthwise of the plate 21 (or leftwardly and rightwardly in FIG. 2) and receiving a bent portion 39 of the throttle lever 22.

Figure 3:
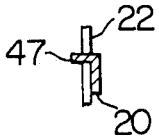

The throttle lever 22 which is located in superposed relation to the control lever 20 is fitted over the boss 27 for pivotal movement. As shown in FIG. 1, the throttle lever 22 extends upwardly from the vicinity of the bolt 29 and has a connecting portion 41 extending from an intermediate portion of its length toward the suction conduit 2 and connected to a forward end of the governor lever 18 through a tension coil lever 42. Located in the vicinity of an upper end 40 of the throttle lever 22 is a stopper bolt 43 which extends horizontally above the link plate 21 toward the upper end 40 and is threadably fitted in an threaded opening formed in a bracket 45 on the crankcase and secured in place by a lock nut 46. As shown in FIG. 3 which is a sectional view taken along the line III—III in FIG. 1, the control lever 20 has a bent portion 47 which is positioned against a lower portion of the throttle lever 22. The bent portion 47 is located in the vicinity of the end of the base of the choke arm portion 32 as shown in FIG. 1 so as to abut against the throttle lever 22 from the side of the governor arm 17 (or the left side of the lever 22 in FIG. 1).

In operation, as the inner cable 24 is pulled to a maximum to hold the control lever 20 in a full-open throttle position as shown by solid lines, the bent portion 47 of the control lever 20 pivotally moves the throttle lever 22 to a position in which it is brought into abutting engagement with the stopper 43 and the throttle lever 22 pulls the governor lever 18 through the spring 42. Thus, the governor arm 17 pulls the lever portion 15 through the spring 16 and rod 16*a* to hold the throttle valve in a full-open position. When the throttle lever is in the full-open position as aforesaid, the bent portion 39 of the throttle lever 22 moves the link plate 21 in pivotal movement to a substantially horizontal position as shown by solid lines, so that the link plate 21 is upwardly spaced apart a great distance from the forward end of the link arm portion 31. The choke arm portion 32 has its upper end located obliquely upwardly of the arm portion 7 of the choke valve 3, and the choke valve 3 is kept in an open position by the biasing force of the spring 12.

As the inner cable 24 is manipulated to push the connecting arm portion 30 backwardly halfway through its whole stroke of movement to pivotally move the control lever 20 to an idling position 30′ shown by dash-and-dot lines in FIG. 1, the throttle lever 22 is moved to an idling position 22′ by an increase in the tensile force of the spring 42 and the arm 17 and lever 18 are moved to idling positions by a reduction in the tensile force of the spring 42, to thereby bring the throttle valve to a full-closed position. With the throttle valve in the full-closed position as aforesaid, the bent portion 39 of the throttle lever 22 moves the link plate 21 clockwisely in FIG. 1, and the link arm portion 31 which has moved to an idling position 31′ has its forward end located near the link plate 21. The choke arm portion 32 has its forward end located near the arm portion 7 of the choke lever 5.

As the inner cable 24 is pushed to the maximum to pivotally move the control lever 20 to a choking position 20″, the choke arm portion 32 moves to a dash-and-two-dot line position 32″ to move the arm portion 7 downwardly to cause the shaft 4 to rotate, to thereby bring the choke valve 3 to a full-closed position. At the same time, the link arm portion 31 is brought into engagement at its forward end with the link plate 21 to cause same to pivotally move in the direction of an arrow R shown in FIG. 1. This causes the throttle lever 22 which is maintained in engagement at its bent portion 39 with the link plate 21 to pivotally move in a throttle opening direction to a half-open throttle position 22″. The lever portion 15 is also moved to a half-open throttle position through the spring 42, arm 17 and lever 18.

From the foregoing description, it will be appreciated that according to the invention a linkage having the control lever 20 is operatively connected to a throttling mechanism and a choking mechanism of the engine while the lever 20 is connected to an operating mechanism (Bowden wire 23). A full-open throttle position (solind line position) and a choking position 22″ are set at opposite ends of the range of movement of the lever 20 while an idling position 20′ is set midway between the full-open throttle position and the choking position 22″. Thus, the lever 20 (linkage) holds the choking mechanism in a full-closed position when the lever 20 is disposed in the choking position 20″ and opens and closes the throttling mechanism when it moves between the idling position 20′ and the full-open throttle position. The linkage is connected with the throttling mechanism when the lever 20 is in the choking zone between the idling position 20′ and the choking position 20″ to move the throttling mechanism as far as a partly-open position as the lever 20 moves in the choking zone toward the choking position. The degree of opening of the throttle valve may, of course, be freely selected by adjusting the movement of the link plate 21. The use of the common control lever 20 for rendering operative the choking mechanism and the throttling mechanism facilitates startup of the engine. Moreover, the provision of the full-open throttle position and the choking position at the opposite ends of the range of movement of the control lever 20 enables waste of the fuel to be avoided and allows the misoperation of keeping the throttle valve in a full-open position while closing the choke valve 3 in normal operation of the engine to be prevented from occurring. Also, when choking is relied on at engine startup, the control lever 20 can be returned to the idling position 20' without passing through the throttle full-open position. This is conducive to prevention of a sudden rise in the number of revolutions of the engine following engine startup. Furthermore, when an attempt is made to use common specifications for the fuel control system of the integrated type according to the invention described hereinabove and a fuel control system of a separation type, the need to change a governor spring and other parts is eliminated even if the fuel control system is used for an engine with a governor as is the case with the embodiment of the invention shown and described hereinabove, so that the use of common specification is facilitated and a reduction in production cost can be achieved.

Figure 4:
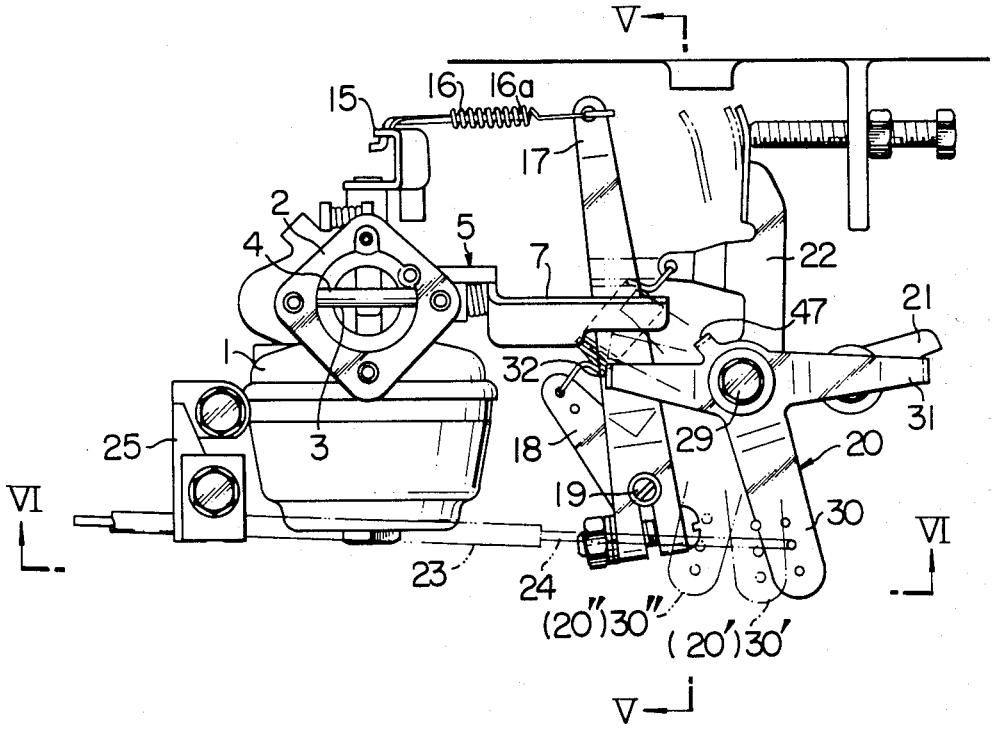
FIG. 4 is a front view of the integrated fuel control system for a gasoline engine comprising another embodiment.
Figure 5:
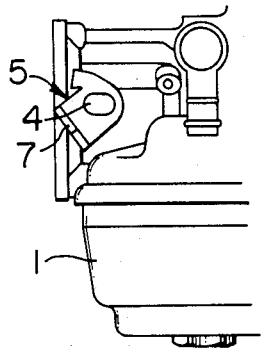
FIGS. 5 and 6 are views as seen in the directions of arrows V—V and VI—VI respectively in FIG. 4.
Figure 6:
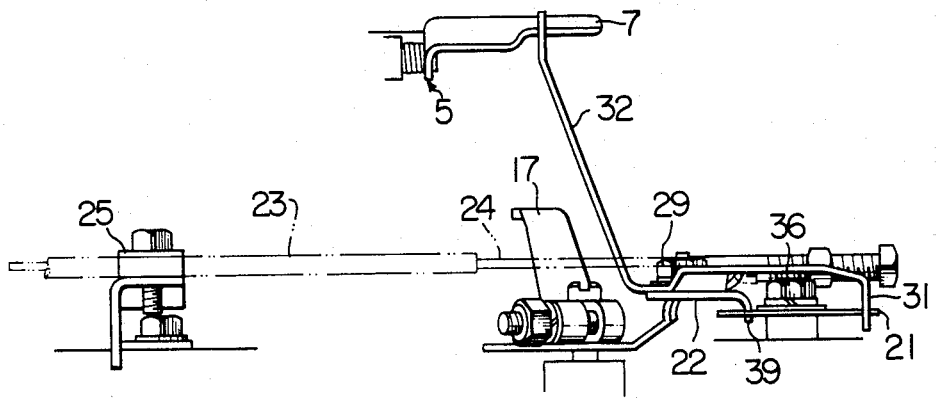

FIGS. 4–6 show another embodiment of the invention. In the fuel control system shown in FIGS. 4–6, the choke valve 3 is brought to a closed position as the choke arm portion 32 of the control lever 20 pushes the arm portion 7 of the choke lever 5 upwardly. The control lever 20 which moves to a full-open throttle position when it is pushed to a maximum as indicated by solid lines by the inner cable 24 holds the throttle lever 22 in the full-open throttle position through the link plate 21 when it is disposed in the full-open throttle position described hereinabove. Also, the control lever 20 moves to the choking position 20'' when it is pulled to a maximum by the inner cable 24, and as the control lever 20 moves from the intermediate idling position 20' to the choking position 20'', the choke arm portion 32 of the control lever 20 moves the arm portion 7 of the choke lever 5 upwardly to close the choke valve 3, and at the same time the bent portion 47 moves the throttle lever 22 to a partly-open throttle position. FIGS. 5 and 6 are views as seen in the directions of arrows V—V and VI—VI respectively in FIG. 1, and in FIGS. 4–6, parts similar to those shown in FIGS. 1–3 are designated by like reference characters.

While preferred embodiments of the invention have been described using specific terms, such description is for illustrative purposes only, and it is to be understood that changes and variations may be made without departing from the spirit or scope of the following claim.

What is claimed is:

1. An integrated fuel control system for a gasoline engine, comprising:

a linkage for controlling a throttle valve and a choke valve of the gasoline engine in correlation with each other according to a single command operation performed by an operator, said linkage being composed of a plurality of pivotable members operatively associated with one another in such a manner that as one of said pivotable members is actuated by the operator, the rest of the pivotable members are maintained in engagement with said one pivotable member either continuously or intermittently, said one pivotable member operated by the operator having a full power position and a choking position at opposite ends of the range of movement thereof, and an idling position midway between said two end positions, said linkage being so adapted to successively open the throttle valve when said one pivotable member is moved from the idling position to the full power position, while to successively close the choke valve and successively open the throttle valve up to a partly open position when said one pivotable member is moved from the idling position to the choke position.

* * * * *